United States Patent [19]

Metz

[11] Patent Number: 4,863,509

[45] Date of Patent: Sep. 5, 1989

[54] METHOD AND APPARATUS FOR PRODUCING AND FURTHER PROCESSING METALLIC SUBSTANCES

[75] Inventor: Paul Metz, Luxembourg, Luxembourg

[73] Assignee: Centrem S.A., Luxembourg

[21] Appl. No.: 97,479

[22] Filed: Sep. 16, 1987

[30] Foreign Application Priority Data

Sep. 16, 1986 [LU] Luxembourg ..... 86 588
Dec. 9, 1986 [LU] Luxembourg ..... 86 707

[51] Int. Cl.[4] ..... B22F 9/10

[52] U.S. Cl. ..... 75/0.5 C; 219/7.5; 264/8; 425/8

[58] Field of Search ..... 75/0.5 C; 264/8; 425/8; 219/7.5

[56] References Cited

U.S. PATENT DOCUMENTS 3,581,040 5/1971 Halley ..... 219/7.5

FOREIGN PATENT DOCUMENTS 1949053 9/1970 Fed. Rep. of Germany .
1106022 12/1955 France .
1205683 2/1960 France .
2086085 12/1971 France .
2352612 12/1977 France .
2391799 12/1978 France .
66760 12/1972 Luxembourg .
1136732 12/1968 United Kingdom .
2043701 10/1980 United Kingdom .

*Primary Examiner*—Robert McDowell
*Attorney, Agent, or Firm*—Fishman, Dionne & Cantor

[57] ABSTRACT

Liquid metal undergoes rapid rotational motion in an induction field and utilizes the resultant centrifugal forces to extend the metal in the form of a rotating film, the film becoming progressively thinner, along a baffle surface located in the induction field. The liquid metal can then emerge through the baffle surface in the form of wires or can be reduced in size on a cylindrical impact wall and then cooled.

38 Claims, 7 Drawing Sheets

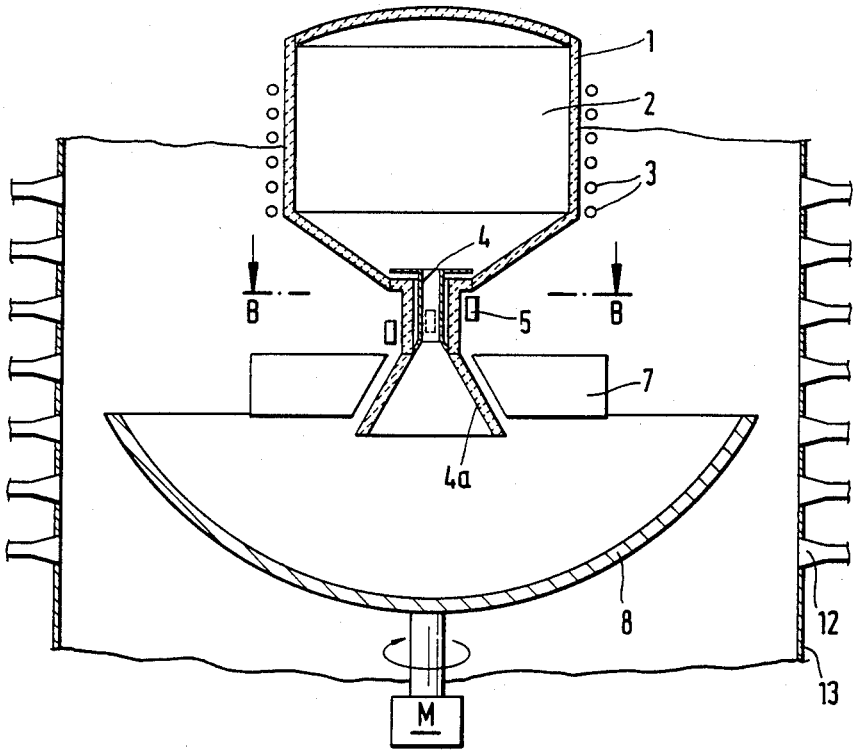
FIG.1
FIG.1B
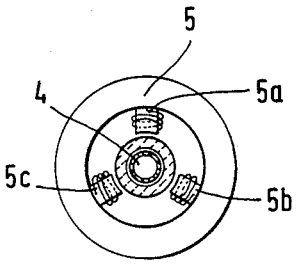

METHOD AND APPARATUS FOR PRODUCING AND FURTHER PROCESSING METALLIC SUBSTANCES

BACKGROUND OF THE INVENTION

This invention relates to a method and apparatus for producing and further processing metallic substances by direct action on liquid metal using centrifugal forces of a rotating induction field, the rotating induction field having initially set the liquid metal in rotation in a rotationally symmetric container wall.

It is known to separate and cool liquid metals in such a way that extremely finely divided metallic powders or wires develop. The cooling rate of the liquid metal determines the structure of the products produced; very high cooling rates even lead to gaseous, i.e., amorphous structures.

Various methods are known for achieving these goals. One of these methods consists of allowing the metal to be atomized or cooled by directing the metal to flow out of a crucible (usually heated and under pressure), through a nozzle provided with a relatively small opening. The metal is then separated and cooled by gas jets or by rapid rotation in usually cooled plates, hollow spherical vessels, cylinders, etc. A combination of these methods has also been proposed.

Other methods provide for metals to be rapidly cooled by introducing them into a liquid which is forced at right angles onto a container wall by centrifugal forces.

However, these known methods have the disadvantage that rapidly rotating components are required, which at these high speeds, lead to unbalance and contamination problems.

The above discussed problems do not exist in the method disclosed by FR-A-2,391,799. In that method, the rotational motion of the liquid metal is brought about inductively and so movable parts are not required. Nevertheless, this known method has a disadvantage in that the liquid metal is rotated in a pipe which is closed at the bottom except for a small central opening nozzle through which the metal must also leave the pipe. This small nozzle presents two important problems. First, the output from the nozzle is limited; and second, this nozzle represents a blockage risk and is subjected to rapid abrasion wear. In addition, as a result of the centrifugal force, the liquid metal is thrust in a tubular form onto the inner wall of the pipe during the rotational motion and therefore has hardly any chance to escape through the axially arranged nozzle.

SUMMARY OF THE INVENTION

The above discussed and other problems and deficiencies of the prior art are overcome or alleviated by the novel method and apparatus for processing metallic substances of the present invention which dispenses with the known disadvantages of the prior art and in addition, provides new and improved metallurgical processing techniques.

In accordance with the method of the present invention, a rotating induction field is used to generate centrifugal forces for extending the liquid metal in the form of a rotating film, which becomes progressively thinner along a baffle surface located in the induction field. In many cases, cooling liquid metal centrifuged in this manner is sufficient to achieve the desired product. This cooling can be effected by known methods, e.g. by gas, vapor, or liquid cooling and/or by impacting onto a cold wall.

In still other cases, however, where a more extensive separation or more rapid cooling of the product produced is desired, the product separated by the inductive centrifuging described above can be further separated or cooled by known methods such as gas atomization and/or impact atomization onto rotating objects or in liquids or in an inductive moving and cooling device.

In accordance with the apparatus of the present invention, inductive rotary motion is produced in a tubular nozzle arranged beneath a supply container. However, in most cases, it is preferable to widen this nozzle conically downwards or to provide it with a conical extension (and thus provide an inverted funnel shape); and set the inductive rotary motion partly or completely in this widened section, with the narrow nozzle cross-section itself being subjected to less abrasion.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES:

FIG. 1 is a cross sectional elevation view of a first embodiment of the present invention;

FIGURE 1B is a cross sectional elevation view along the line B—B of FIG. 1;

DESCRIPTION OF THE PREFERRED EMBODIMENT

Figure 2:
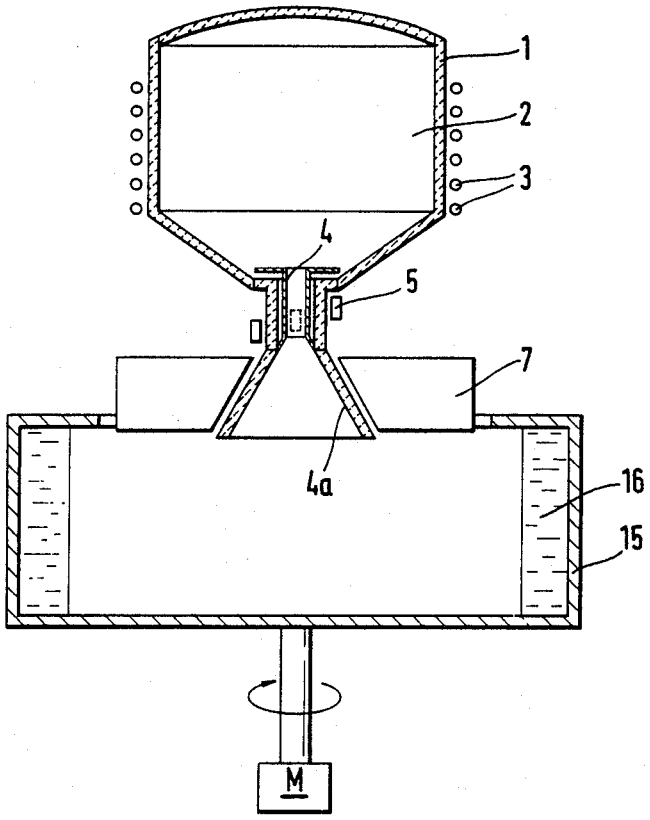
FIG. 2 is a cross sectional elevation view showing a variation of the embodiment of FIG. 1.

The present invention relates to several embodiments of a method and apparatus in which a rotating induction field is used to generate centrifugal forces for extending the liquid metal in the form of a rotating film which becomes progressively thinner along a baffle surface located in the induction field. The apparatus for carrying out this method comprises a tubular nozzle arranged beneath a supply container. Preferably, the nozzle conically widens downwards; and the inductive rotary motion is provided partially or completely in this widened section.

In another embodiment of the apparatus in accordance with the present invention, the conical widened section is configured downwardly in such a way that the entire discharge opening assumes a hyperboloidal or trumpet-like shape, with it being possible for the rounded or flattened part to be exposed to a widened or another flat inductor system. In this way, the metal is subjected to very high acceleration; and consequently to very extensive centrifuging and separation. In individual cases, it can be appropriate to attach a further flat inductor beneath the flattened hyperboloid in such a way that metal is further separated in the annular gap between the trumpet-shaped baffle surface and the flat inductor. To protect the refractory lining of the inside of the diverting widened section or extension, it is preferable to attach a cooling system between this diverging baffle surface and the inductors. This cooling system can be so intensive that a thin, solid metal coating deposit from which continuously protects these parts.

The present invention also contemplates assisting the inductive rotary motion in the widened section of the nozzle (e.g. in the conical extension or in the hyperboloidal or trumpet-shaped widened section) by suitable means for providing mechanical rotary motion.

A further embodiment of the apparatus of the present invention comprises means for directing the metal which flows out of a tubular nozzle (with or without inductive rotary motion of the metal stream), onto a plate-shaped inductor in such a way that the metal on the plate is subjected to centrifuging. If it is desired to achieve fine wires, the inductive plate can be provided with curved grooves or ribs in such a way that the finely divided metal is collected on these grooves or ribs and leaves the installation in wire form. Similarly, the present invention also contemplates assisting the inductive rotary motion on the inductor plate by mechanical rotary motion of the same plate.

It is particularly advantageous if an impact surface (which rotates in the same or opposite direction to the out-flowing metal stream) is not rotated mechanically, but instead the metal particles themselves are subjected to a rapidly rotating induction field by inductors arranged on or around the impact surfaces. This method has the advantage of creating a system which results in excellent separation and cooling of the metals without movable components, so that the entire method can be executed without problems under high vacuum.

Moreover, it has been found that the bodies or liquids used for catching or for impacting (depending on the intended use of the product achieved), can have the same direction of rotation as the inductively centrifuged metal flow; or, for increasing the impact effect or the cooling effect, can be rotated in the opposite direction.

In addition, it has been found that the centrifugal force produced essentially depends on the electric current frequency used, and that, when producing very fine or very rapidly quenched products, frequencies of several hundred or several thousand Hz are suitable.

In mass casting of metals such as aluminum, steel, etc., it has already been proposed several times to influence the casting speed by surrounding the outlet with a travelling field inductor, the electrical loading of which represents a control variable. In the method of the present invention, the application of this principle in the case of very small outlets can lead to a substantial enlargement of the outlet and thus facilitate operation. In accordance with this invention, it has been found that a helicoidal arrangement of the inductors can lead to an additional means of regulating the liquid metal flow and consequently the end effect, with a helicoidal induction field upwardly directed leading to a reduction in the throughput; and a helicoidal induction field downwardly directed leading to an increase in the throughput.

If the method of the present invention is used correctly, large centrifugal forces of the liquified metal can be achieved such that a pipe can be continuously centrifuged onto a cylindrical impact wall. The wall thickness of this pipe can extend from 1 mm up to several centimeters. This pipe can be drawn off continuously and then be rolled as a pipe. However, it can also be split so that after straightening, a continuous metal strip develops. This metal strip can then be further worked (hot and/or cold). Cutting off the continuously formed pipe cross-section can be facilitated by the impact wall having a conicity widened slightly downwardly.

The method of the Present invention described thus far essentially relates to a liquid metal flow which, apart from being exposed to the rotating induction field, is also subjected to its own gravitational force. However, in accordance with the present invention, it has been found that the application of a rotating induction field to a quantity of metal moving simultaneously in the opposite direction to the direction of the gravitational force leads to a substantial increase in the effect of the induction forces. In this way, control by means of flow nozzles can be dispensed with in many cases; so that other control means may be used.

According to this aspect of the present invention, the metal is conveyed by inductors in a direction essentially opposite to the direction of the gravitational force and is subjected at the same time to a rotating induction field in such a way that the metal is set in rapidly rotating motion and subjected to centrifugal forces driving upwardly; with the metal flow being substantially divided when leaving the device. The device for performing this embodiment of the method of the present invention preferably comprises a conical baffle surface which is closed at the bottom and widened towards the top. The baffle surface is provided with inductors such that a rotating induction field is produced inside the cone. As a result, metal located in the cone is centrifuged and, on account of the conical configuration, is at the same time conveyed upwardly in a spiral shape.

Increasing the divergence of the cone continuously upwards, i.e. in a trumpet shape or by steps, and providing the baffle surface thus formed with several inductors is particularly advantageous. These inductors can have the same rotation speed. However, designing or feeding in the inductors in such a way that the rotational speed is increased from the bottom upwards has also been found to be particularly advantageous. Similarly, providing the upper part of the baffle surface with a hyperboloid-like or trumpet shaped discharge form is particularly preferable.

As in the previously discussed embodiments, this embodiment of the apparatus in accordance with the present invention does not exclude assisting the inductive rotary motion of the device or the conical baffle surface with its possibly allocated hyperboloid-like or trumpet shaped discharge configuration with mechanical rotary motion. The diverging baffle surface can likewise be positioned at the upper end opposite a flat inductor in such a way that an annular gap develops between the discharge and the flat inductor.

The lower part of the diverging container normally consists of a flat or disc base, with there being an essentially cylindrical intermediate jacket between the base and the conical part. This lower part, in which the liquid metals to be treated are introduced from below or from above, is preferably heated. The lower conical and/or cylindrical part is preferably provided with controllable inductors, directed helicoidally upwards, so that the metal flowing in the lower part can be brought in a controlled manner into the area of the powerful centrifugal inductors attached around the conical part; and can be further treated in this area.

As already mentioned, the present invention can be actuated with or without a control nozzle. If it desired to work with a control nozzle, this control nozzle can convey the metal through the axis of the cone or the diverging baffle surface down to the base and allow the metal therein to discharge in a controlled form. In this case, the supply container is located above the installation. This arrangement has the advantage of not affecting the centrifuging circuit. In other cases, it will be possible to introduce the metal to be atomized from below, e.g. through a U-pipe, into the base or into the cylindrical part. In still other cases, it is possible to design the cylindrical part and/or a part of the cone as an induction furnace, where the metal to be atomized is melted or brought to the desired temperature, or simply held at a constant temperature.

The quantity of metal to be removed can be controlled by the lowermost inductors, which can act helicoidally. Otherwise, it has been found that the inductors attached on the conical or hyperbolic surface can likewise have a helicoidal action directed downwards or upwards.

At least those parts of the apparatus of the present invention exposed to the inductors should preferably be made of non-magnetic or electrically non-conducting materials.

It will be appreciated that the liquid metal to be treated, introduced in the lower part of the apparatus is, if necessary, heated in said lower part, is conveyed upwards and, in the diverging part, is subjected to centrifugal forces by powerful inductors, which if necessary are arranged in several planes. This metal is then moved upwards at the diverging baffle surface by these centrifugal forces in order to be centrifuged and atomized at high speed at the upper end of the cone or at its trumpet-shaped widened section. It has been found that this embodiment of the present invention, in which the metal is moved in an opposite direction to the direction of the gravitational force, is likewise very well suited for producing very fine wires (the cone, for example, being made in the hyperboloidal discharge form and this discharge form being provided with grooves or ribs). The wire thus produced, as already described above, can be immediately collected in liquid cooling containers.

The apparatus of the present invention also enables the metal to be flung or atomized in a specific direction, which is very favorable in many applications, e.g. in built-up coatings. In this embodiment, the upper part of the cone is provided with a lid and the cone itself, in the direction of the product to be coated, is provided with one or several slots, which enable the finely divided meal used for atomization or coating to be discharged. The excess metal can be returned via a pipeline at the base of the device. In this case, it may be preferable to position the installation either at an angle or horizontally.

It has turned out to be particularly advantageous for the device to be constructed in such a way that the parts exposed to the metal bath, such as the cone (with or without a cylindrical lower part and if necessary with a hyperboloidal upper part), may easily be installed in and removed from the other parts of the installation such as inductors, necessary heating systems or cooling systems. Such construction may be necessary for reasons relating to the quality of the metals to be atomized or for wear reasons.

Turning now to a discussion of the FIGURES, in the embodiment shown in FIG. 1, liquid metal 2 is located in a crucible 1 which is surrounded by an induction heating system 3. The crucible is equipped with a tubular nozzle 4 which is made as wear resistant as possible and is surrounded by an inductor 5 arranged in a helicoidal manner. Inductor 5 is mainly used for controlling the metal flow through nozzle 4, with a helicoidal motion directed upwardly inhibiting the flow and a helicoidal motion directed downwardly increasing the flow rate through nozzle 4. Located beneath nozzle 4 is a diverging baffle surface 4a which either comprises a conical widened section of nozzle 4 or a conical extension beneath nozzle 4. A very powerful inductor 7 is located around this conical baffle surface. The metal flow running through nozzle 4 is set in rapid motion by inductor 7 working at 200 Hz, so that at the discharge of the nozzle, the metal flow has a theoretical rotational motion of 12,000 rev/min., which leads to centrifuging of the metal. The metal thus centrifuged can be directly flung onto a cylindrical impact wall 13, cooled by nozzles 12, and if necessary set in rotary motion, with finely divided metal particles developing.

If it is desired to stimulate further separation, the stream can be collected by a hollow spherical vessel 8, rapidly rotated by means of a motor M, and flung onto impact wall 13 to provide further separation.

FIG. 1B shows a section through inductor 5 which controls the flow in nozzle 4. The poles 5*a*, 5*b*, and 5*c* are to be slightly offset so that a helicoidal rotary field develops which can influence the flow in the positive or negative direction. Inductor 7 is constructed like inductor 5 in FIG. 1B, is made considerably more powerful, (if necessary multipole embodiment) and without the poles being offset.

In FIG. 2, a variation of the FIG. 1 embodiment is shown. In this variation, the impact wall 13 from FIG. 1 has been replaced by a cooling centrifuge 15 which is set in rapid rotational motion by an electric motor. The cooling liquid 16 contained in centrifuge 15, during the rotation, is displaced in an annular shape against the inner wall by the centrifugal force and receives the metal flung off from baffle surface 4*a*.

Figure 3:
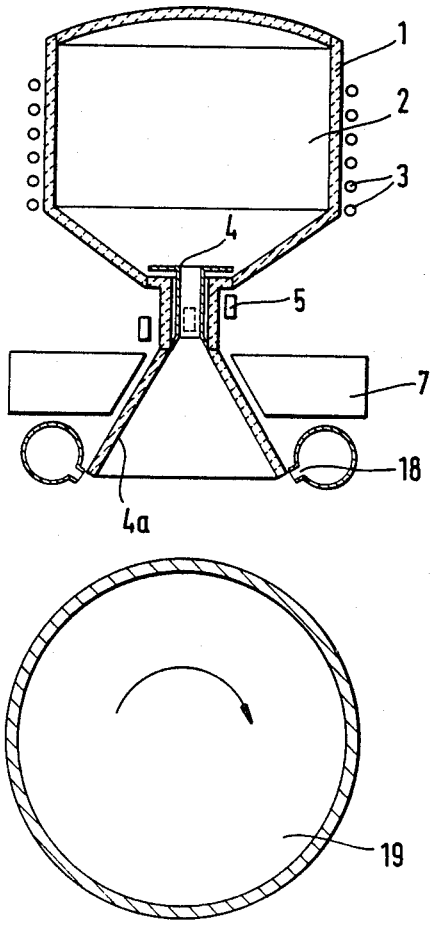
FIG. 3 is a cross sectional elevation view of still a further variation of the embodiment of FIG. 1.

Still another variation of the FIG. 1 embodiment is shown in FIG. 3. In FIG. 3, the lower edge of the baffle surface 4*a* is equipped with nozzles 18. The metal particles are exposed to compressed gas jets discharging from nozzles 18 and are then guided towards a rotating water-cooled drum 19.

Figure 4:
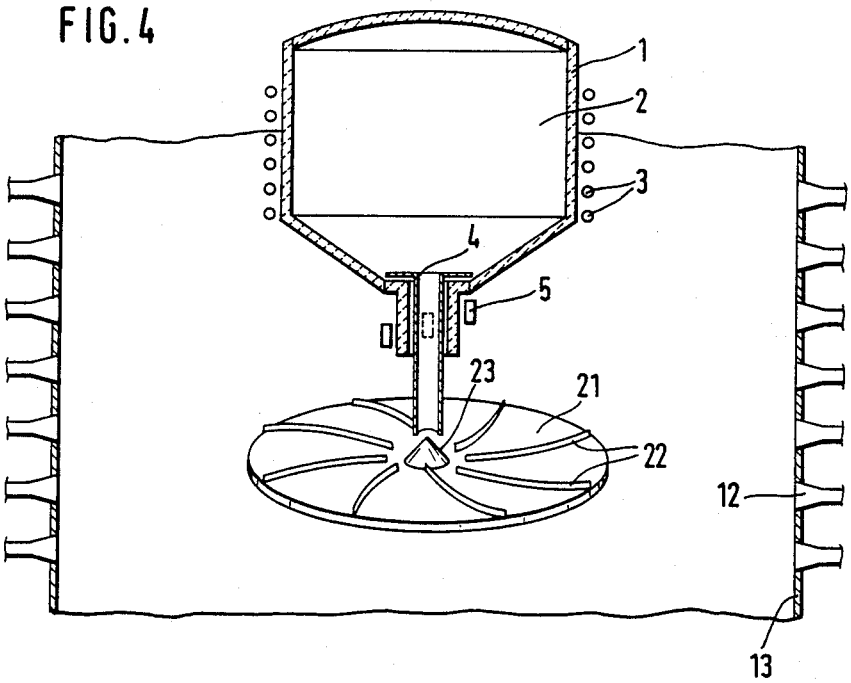
FIG. 4 is an elevation view, partly in cross section of a second embodiment of the present invention.
Figure 4A:
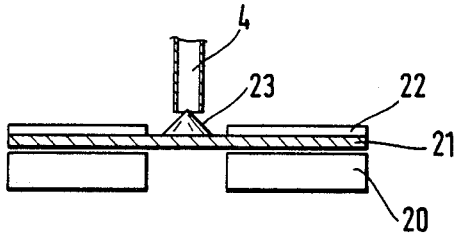
FIG. 4A is a cross sectional elevation view through the distribution plate of FIG. 4.

FIG. 4 shows an installation for producing fine wires in which liquid metal 2 flows out of container 1 (heated by heating device 3) through nozzle 4 onto a plate 21 provided with a powerful inductor 20 and is then centrifuged. Curved recesses and/or ribs 22 cause the metal to leave the plate in very thin metal streams which are then cooled and rolled as rapidly as possible in cold gases, vapors or liquids. Since the plate is static and a centrifugal force results only on the basis of electroinductive effect, the cooling or coiling of the wires is much simpler than in the known mechanical rotary plates. As in the FIG. 1 embodiment, the helicoidal inductors 5 are attached in such a way that they control the flow of the metal through the nozzle 4. FIG. 4A represents the section of the distribution plate 21 of FIG. 4 and shows the nozzle 4, the plate 21 with the grooves or ribs 22, and the inductors 20. An optional conical attachment 23 with the tip of the cone facing nozzle 4, ensures that the metal is uniformly distributed over the entire plate.

Figure 4B:
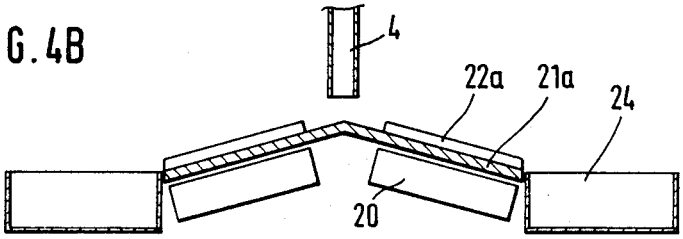
FIG. 4B is a cross sectional elevation view of a variation of the distribution plate of FIG. 4A.

FIG. 4B shows a conical embodiment of a distribution plate 21*a* with the grooves or ribs 22*a* and the inductors 20. This embodiment enables the finely divided molten metal streams to be immediately caught in a basin 24 which is filled with liquid and, if necessary, is rotatable about the main axis, with a very rapid cooling of the streams produced along with considerable length of the wires produced being achieved.

Figure 5:
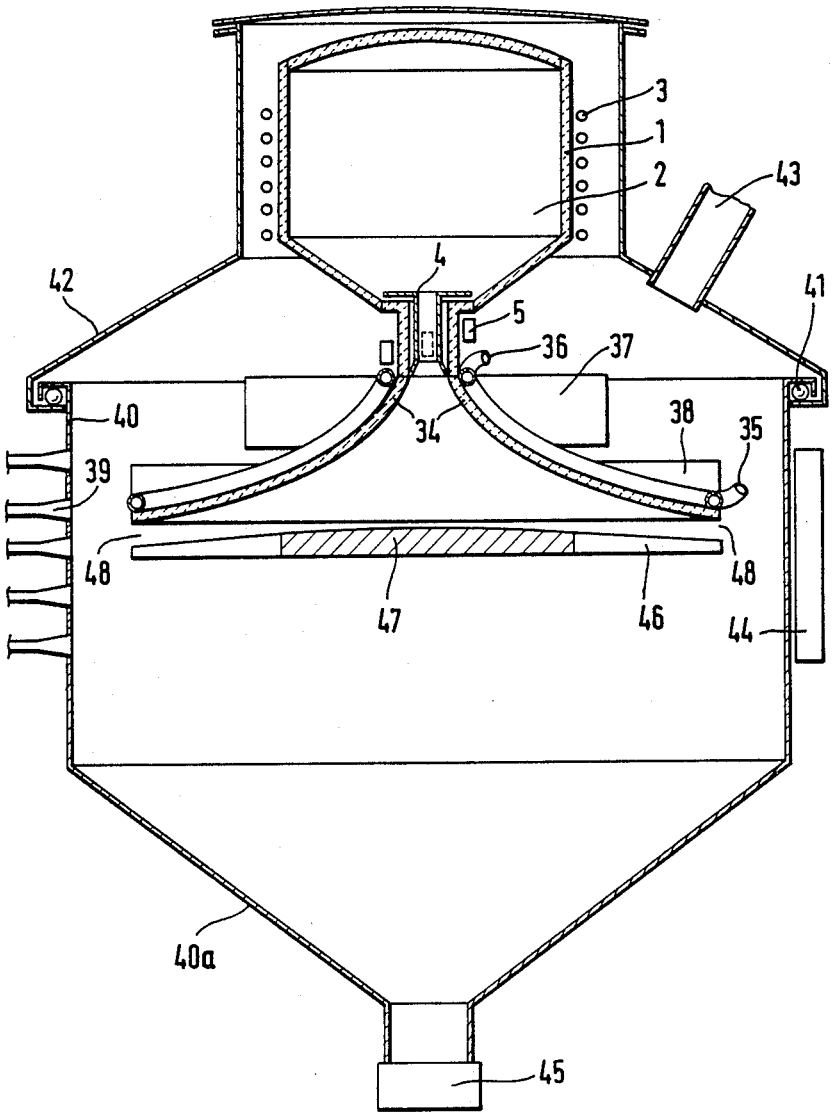
FIG. 5 is a cross sectional elevation view of a third embodiment of the present invention.

FIG. 5 depicts an installation which has been further developed and which meets extremely high qualitative demands. The FIG. 5 installation includes a crucible 1 which contains liquid metal 2, the temperature of which is controlled by inductive heater 3. The metal, if necessary, is conveyed by a slight positive pressure and flows through the abrasion-resistant nozzle 4 which is provided with a small cylindrical bore. Next, the metal is extended by a trumpet-shaped or hyperboloidal refractory and abrasion resistant baffle surface 34. The entire surface of item 34 is cooled by a liquid which is introduced into closed cooling coils at 35 and is drawn off at 36. The quantity of the flow of metal entering into nozzle 4 is controlled by the helicoidal inductors 5. At the same time, a slight rotary motion of the rotary stream may be produced. Once the metal enters into the space defined by the baffle surface 34, the powerful inductors 37 set the metal in a very rapid rotary motion which is then accelerated further by flat inductors 38 such that, at the lower edge of the trumpet-shaped baffle surface 34, the metal particles are flung at very high speed onto the cylindrical wall 40 cooled by water nozzles 39. It will be appreciated that wall 40 can be rotated in the ball bearing arrangement 41 by a drive device (not shown). However, if it is desired to carry out atomization under vacuum, wall 40 is tightly connected to a hood 42 and the entire enclosed installation is evacuated via a connecting piece 43. In this case, the metal flung onto wall 40 can be moved further and distributed by the inductors 44 which are attached around the cylindrical wall 40. The metal particles produced collect in the lower funnel-shaped part 40*a* from which, after a valve 45 is opened, they can be drawn off and fed directly to a compacting installation after optional intermediate heating.

If it is desired to achieve an even greater acceleration of the metal particles discharging beneath the baffle surface 34, a ring 47 provided with flat inductors 46 can be attached beneath the diverging baffle surface 34 so that an annular gap 48 develops between the baffle surface 34 and the ring 47 (through which annular gap 48 the metal particles are accelerated even further). To prevent the metal from freezing in annular gap 48, ring 47 can be heated, e.g. by the inductors 46.

The rotary direction of the entire system, brought about by inductors 37 and 38 (and possibly 46), is to be the same in all cases. However, the impact wall 40 or the inductors 44, depending on the desired condition of the end product, can work in either the above mentioned direction of rotation of the previously mentioned inductors or the opposite direction. When leaving annular gap 47, the separated products can be further treated in the same way as described above.

A similar device as shown in FIG. 5 can lead to the manufacture of pipes or, after the pipes have been split, to the manufacture of flat products. In this case, the impact wall 40 will be in a slightly conical configuration which widens towards the bottom. The funnel-shaped extension 40 is omitted. The cooling nozzles 39 are then laid out so sparsely that the particles discharging from gap 48 become welded to each other, with the inductors 44 ensuring that the centrifuged particles are uniformly distributed. In the case of large throughputs, the separated metal flow between annular gap 48 and impact wall 40 is cooled by a cooling system, preferably an inert-gas cooling system.

The pipe developed by centrifuging and welding together is drawn continuously through an extraction installation (not shown) and then rolled, e.g., in a planetary skew rolling mill. As already mentioned, the formed pipe can be split and, in the form of a continuous strip, can if necessary after that be hot and/or if necessary cold rolled and coiled.

Whereas in the exemplary embodiments described above, the metal is centrifuged from the top, in the following exemplary embodiments in accordance with FIGS. 6 and 7, the metal is conveyed or centrifuged in a direction opposite to the direction of the gravitational force, i.e. from the bottom upwards.

Figure 6:
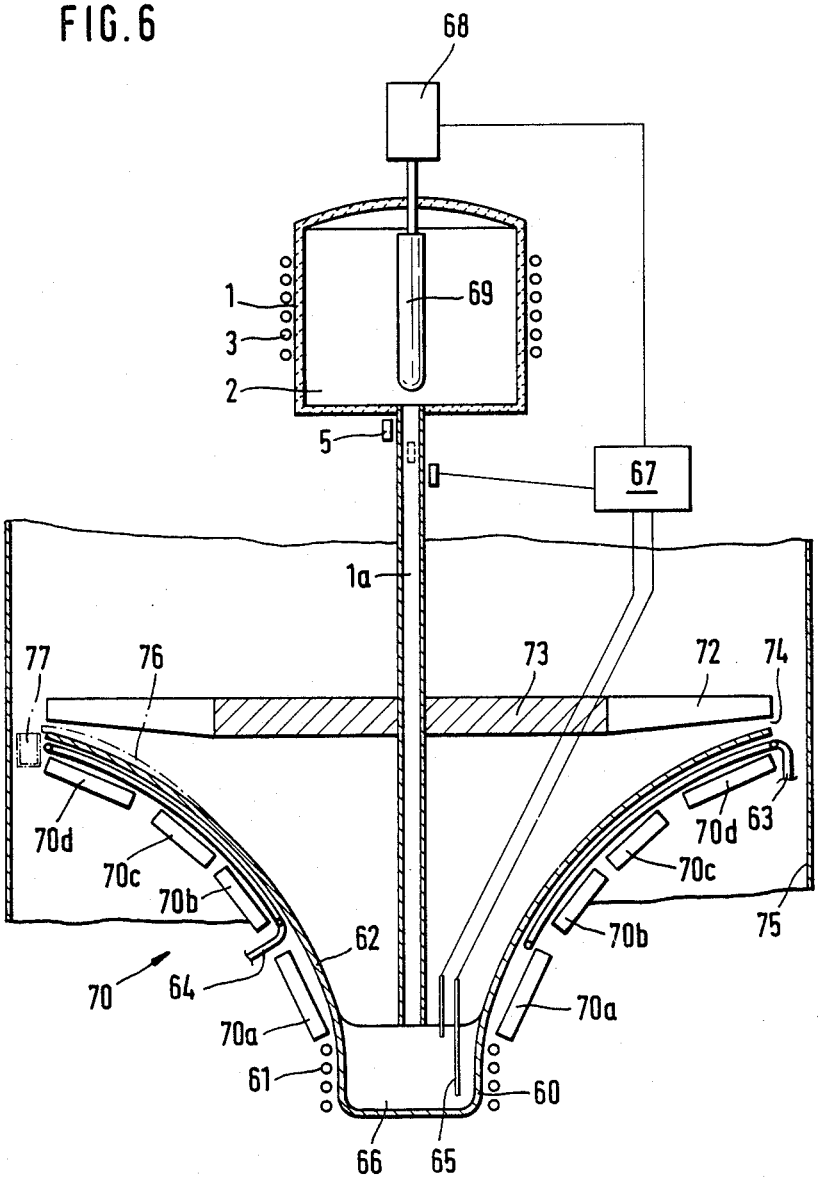
FIG. 6 is a cross sectional elevation view of a fourth embodiment of the present invention.

The apparatus of the present invention shown in FIG. 6 includes a crucible 1 which contains liquid metal 2, the temperature of which is controlled by inductor 3. The metal flows through a line la into a container 60 which, if necessary is configured as a cylindrical supply container heated by inductors 61 and is extended upwards by a refractory and abrasion-resistant baffle surface 62 which widens in a trumpet-shape or hyperboloidally. The entire baffle surface 62, or at least the upper most part, is cooled by a liquid which flows, e.g., through cooling coils or is located in an enclosed space and is introduced through inlet 63 and drawn off through outlet 64. Cooling can also be effected via atomizing nozzles. A measuring probe 65 ensures that the molten metal bath 66 in crucible 60 is at a constant level by operating a tacking rod 69 via the controller 67 and a positioning member 68 and/or by acutating the inductors 5 designed as induction valves. A set of inductors is arranged along the underside of the baffle surface 62. The liquid metal is first accelerated by the inductor 70.a and then by the inductors 70*b*, 70*c*, and 70*d*. These inductors can effect a simple rotary motion, but can also be made helicoidal, in which case the lower inductors 70*a* and 70*b*, e.g., produce a helicoidal motion acting upwards and the upper inductors 70*c* and 70*d* can act downwards if necessary in order to subject the metal to the centrifugal forces for as long as possible. It is likewise appropriate for the inductors from 70*a*to 70*d* to be loaded at increasing frequencies. Thus, it is sufficient in most cases for the inductors 70*a*, for example, to be operated at mains frequency, i.e. at 50 Hz, in which case the inductor 70*b* is preferably operated at 200 Hz, the inductor 70*c* at 1000 Hz and the inductor 70*d* at 2000 Hz. It will be appreciated that the metal leaves the baffle surface 62 with very large centrifugal forces and consequently with very considerable atomization.

If even greater acceleration of the metal particles leaving baffle surface 62 is desired, a ring 73 provided with flat inductor 72 can be attached above the diverging baffle surface 62 such that an annular gap 74 develops between the edge of baffle surface 62 and ring 73, through which annular gap 74 the metal particles are accelerated even further. To prevent freezing of the metal in this annular gap, ring 73 can be heated, e.g. by the inductors 72.

As already mentioned, an up and down motion of the apparatus relative to the impact wall 75 or vice versa can lead to greater regularity in the product achieved.

The apparatus of FIG. 6 can also be used to produce fine wires by the discharge side of the baffle surface being provided with elevations and/or ribs 76. In this case, the desired quantity of metal is collected and, as described in FIG. 4B, caught in a basin 77 which is filled with liquid and is rotatable if necessary, with a very rapid cooling of the streams produced and a considerable length of the wires produced being achieved (left hand side of FIG. 6).

The installation described can likewise be used for coating metal strips which are drawn through the installation either in a spiral shape or bent temporarily in a tubular shape. Also, the installation described above can centrifuge over its entire periphery. However, if it is desired to centrifuge in a certain direction, e.g. for producing thin wires or for further atomization by gas jets, the installation can be set at an angle or horizontally.

Figures 7, 7A:
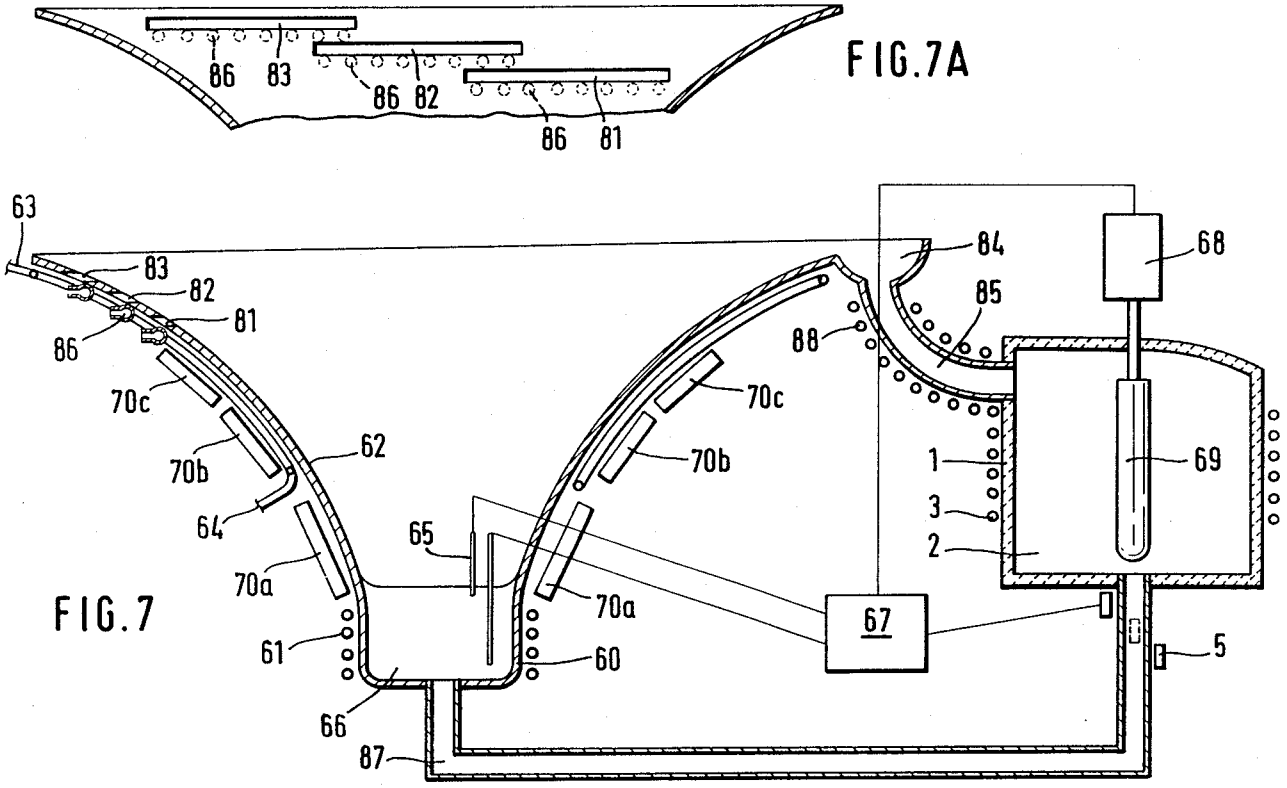
FIG. 7 is a cross sectional elevation view of a variation of the embodiment of FIG. 6.
FIG. 7A is an elevation view, partly in cross section, showing details of the upper part of the baffle surface from FIG. 7.

A further embodiment of the present invention, similar to the embodiment of FIG. 6, is shown in FIG. 7. This installation has been specially developed for centrifuging on one side, e.g. for coating purposes or for further atomization by gas jets. In addition, it illustrates the possibility of feeding through a furnace set up next to the installation. The installation shown in FIG. 7 operates according to similar principles as the installation shown in FIG. 6 with the difference that the centrifuged metal is flung out through the opening or slot 81. or the openings or slots 81, 82 and 83 (see also FIG. 7A); and the the excess quantity can be collected in a channel 84 and fed back into the crucible via a return 85. When discharging through the slots, the metal, already finely divided, can be atomized even further by gas nozzles 86 and cooled or conveyed further into a rolling installation. In addition, this device can be closed at the top with a lid.

As illustrated in FIG. 7, crucible 1 is located next to the centrifuging installation and is connected to the supply container 60 via the line 87 according to known principles of communicating pipes. Return 85 into crucible 1 is preferably surrounded by a heating coil 88 in order to prevent premature freezing. Since the gravitational forces are negligible compared with the centrifugal forces, the apparatus of FIG. 7 may also be set up horizontally or at an angle. This especially applies to installations which, in accordance with FIG. 7, work with liquid metal billets discharging through openings or slots in the baffle surfaces. The baffle surface of a diverging or even cylindrical configuration can then be closed on the side opposite the entry of the liquid metal.

In summary, it should be stressed that all of the exemplary embodiments described above have the common feature that a complete liquid metal billet is formed by the centrifugal forces of the inductively induced rotary motion at least at the time that the metal is introduced centrally into the rotationally symmetric baffle surface. It will be appreciated that this feature takes place in the inlet nozzle 4 in the embodiments according to FIGS. 1 to 5. This metal billet centrifuged in a hollow manner then widens conically or in a trumpet shape along the inner baffle surface under the action of the centrifugal force, with a continuous liquid metal film impinging on this baffle surface, the thickness of this metal film decreasing in accordance with the increase in radius. The flow at the inlet of the baffle surface and also the frequency and intensity of the inductive rotary fields are adapted to the dimensions of the baffle surface in such a way that the metal film at the outlet edge of the baffle surface is so thin that the metal film tears and is completely atomized. This principle also applies to the embodiment according to FIG. 4, since the flat plate disc 21 merely represents an extreme case of the diverging baffle surfaces of the other exemplary embodiments.

In contrast, in the known prior art device of FR-A-2,391,799, the liquid metal is neither centrifuged into a film which becomes thinner nor atomized by the centrifugal forces. This is because atomization in this known device is effected outside the inductive rotary field, and in fact, by the increase in pressure produced at the discharge opening by centrifugal forces.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of processing liquid metal using centrifugal forces from a rotating electro-induction field, the induction field setting the liquid metal in rotation inside a rotationally symmetric limiting wall, comprising the further step of:

causing the centrifugal forces to extend the liquid metal along a baffle surface located in the induction field so that the liquid metal defines a rotating film, said rotating film becoming progressively thinner about the periphery thereof; and forming said continuously rotating metal film on said baffle surface so thin whereby said periphery of said film is atomized when flung off from said baffle surface.

2. Method according to claim 1 including the step of: further rotating said liquid metal using centrifugal forces generated by mechanical rotating means.

3. Method according to claim 1 including the step of: cooling said metal subsequent to rotating said metal.

4. A method of processing liquid metal using centrifugal forces from a rotating electro-induction field, the induction field setting the liquid metal in rotation inside a rotationally symmetric limiting wall, comprising the further step of:

causing the centrifugal forces to extend the liquid metal along a baffle surface located in the induction field so that the liquid metal defines a rotating film, said rotating film becoming progressively thinner about the periphery thereof; and continuously impacting the liquid metal against a cylindrical impact wall in order to form a pipe which can be drawn off continuously from the impact wall and rolled.

5. Method according to claim 4 including the step of: further processing said pipe into a metal strip by splitting.

6. A method of processing liquid metal using centrifugal forces from a rotating electro-induction field, the induction field setting the liquid metal in rotation inside a rotationally symmetric limiting wall, comprising the further step of:

causing the centrifugal forces to extend the liquid metal along a baffle surface located in the induction field so that the liquid metal defines a rotating film, said rotating film becoming progressively thinner about the periphery thereof;

conveying said liquid metal under gravitational force in the form of a complete metal billet into a tubular nozzle wherein said metal is preformed into a tubular billet by inductive centrifugal forces; and conveying said metal along a baffle surface spreading out conically or in a trumpet shape in an inductive rotating field thereby forming a conical or trumpet shaped film which becomes progressively thinner at its periphery.

7. A method of processing liquid metal using centrifugal forces from a rotating electro-induction field, the induction field setting the liquid metal in rotation inside a rotationally symmetric limiting wall, comprising the further step of:

causing the centrifugal forces to extend the liquid metal along a baffle surface located in the induction field so that the liquid metal defines a rotating film, said rotating film becoming progressively thinner about the periphery thereof; and wherein said liquid metal is in a vessel and including the step of;

lifting said liquid metal upwardly out of the vessel in the direction opposite to the direction of its gravitational force by inductively induced centrifugal forces.

8. Method according to claim 7 including the step of:

conveying said liquid metal, via a baffle surface widening upwards conically or in a trumpet shape further upwardly and radially outwardly to form a film which becomes progressively thinner at its periphery.

9. A method of processing liquid metal using centrifugal forces from a rotating electro-induction field, the induction field setting the liquid metal in rotation inside a rotationally symmetric limiting wall, comprising the further step of:

causing the centrifugal forces to extend the liquid metal along a baffle surface located in the induction field so that the liquid metal defines a rotating film, said rotating film becoming progressively thinner about the periphery thereof; and forming said rotating metal film in a wire or strip shape by ribs or slots shaped on or in said baffle surface; and cooling said formed metal.

10. Apparatus for processing liquid metal comprising:

container means for holding liquid metal;

centrifuging means associated with said container means;

wherein said centrifuging means comprises;

an axially symmetric baffle surface having an inner and an outer side, inductor means communicating with said outer side;

said container means being connected to said inner side of said baffle surface by an axial connection section; and said inductor means for continuously rotating the liquid metal in said centrifuging means, said inductor means including means for forming a continuously rotating metal film on said baffle surface so thin whereby the periphery of said film is atomized when flung off from said baffle surface.

11. Apparatus for processing liquid metal comprising:

container means for holding liquid metal;

centrifuging means associated with said container means;

first electromagnetic inductor means for rotating the liquid metal in said centrifuging means;

wherein said centrifuging means comprises;

an axially symmetric baffle surface having an inner and an outer side, said first inductor means communicating with said outer side;

said container means being connected to said inner side of said baffle surface by an axial connection section; and wherein said baffle surface comprises a cone.

12. Apparatus for processing liquid metal comprising:

container means for holding liquid metal;

centrifuging means associated with said container means;

first electromagnetic inductor means for rotating the liquid metal in said centrifuging means;

wherein said centrifuging means comprises;

an axially symmetric baffle surface having an inner and an outer side, said first inductor means communicating with said outer side;

said container means being connected to said inner side of said baffle surface by an axial connection section; and wherein said baffle surface widens in a trumpet shape or hyperboloidal shape.

13. Device according to claim 12 wherein said baffle surface includes:

cooling means on said outer side thereof.

14. Device according to claim 12 including:

flat axially symmetric inductor ring means which cooperates with the outer edge of said trumpet shaped baffle surface to define an annular discharge gap.

15. Device according to claim 12 including:

a plurality of third inductor means allocated to said baffle surface, said third inductor means adapted to induce variously orientated rotary fields which are adapted to the change in direction of the deflected metal particles.

16. Device according to claim 12 wherein:

said container means is arranged adjacent to said trumpet shaped baffle surface and is connected to said vessel via conduit means.

17. Device according to claim 12 including a vessel and wherein:

said trumpet shaped baffle surface extends upwardly from the upper edge of the vessel.

18. Device according to claim 17 wherein said container means is arranged above said vessel and including:

a connecting line extending axially through said baffle surface between said container means and said vessel.

19. Device according to claim 17 wherein:

said vessel is surrounded by heating means.

20. Device according to claim 17 including:

measuring probe means for measuring and regulating the metal level in said vessel.

21. Device according to claim 17 wherein:

said first inductor means comprises a plurality of inductor stages.

22. Device according to claim 21 wherein:

said inductor stages can be fed with correspondingly higher current frequencies as said baffle surface widens

23. Device according to claim 17 wherein:

said trumpet shaped baffle surface includes discharge slots near the periphery thereof.

24. Device according to claim 23 including:

collecting channel means at the peripheral edge of said baffle surface; and said channel means being connected to said container means by a heated return conduit.

25. Apparatus for processing liquid metal comprising:

container means for holding liquid metal;

centrifuging means associated with said container means;

first electromagnetic inductor means for rotating the liquid metal in said centrifuging means;

wherein said centrifuging means comprises; an axially symmetric baffle surface having an inner and an outer side, said first inductor means communicating with said outer side; and said container means being connected to said inner side of said baffle surface by an axial connection section wherein said connecting section comprises;

tubular nozzle means which defines an axial outlet for said container means and which, at the bottom thereof, merges into said baffle surface.

26. Device according to claim 25 wherein:

said nozzle means is surrounded by second inductor means which produces a rotary field controlling the flow of liquid metal from said container means.

27. Device according to claim 26 wherein:

said second inductor means has several pole shoes which are arranged helicoidally around said nozzle means.

28. Apparatus for processing liquid metal comprising:

container means for holding liquid metal;

centrifuging means associated with said container means;

first electromagnetic inductor means for rotating the liquid metal in said centrifuging means;

wherein said centrifuging means comprises;

an axially symmetric baffle surface having an inner and and outer side, said first inductor means communicating with said outer side;

said container means being connected to said inner side of said baffle surface by an axial connection section; and wherein said baffle surface comprises fixed circular disc means arranged centrally beneath an outlet from said container means.

29. Device according to claim 28 wherein:

said plate disc means is slightly conical.

30. Device according to claim 28 including:

means on said disc means for conveying said liquid metal outwardly in a radially curved path.

31. Device according to claim 30 wherein said conveying means includes:

groove or rib means running out in a radially curved configuration.

32. Apparatus for processing liquid metal comprising:

container means for holding liquid metal;

centrifuging means associated with said container means first electromagnetic inductor means for rotating the liquid metal in said centrifuging means;

wherein said centrifuging means comprises;

an axially symmetric baffle surface having and inner and an outer side, said first inductor means communicating with said outer side;

said container means being connected to said inner side of said baffle surface by an axial connection section; and wherein said baffle surface is positioned above a centrifuging container partially filled with cooling liquid.

33. Apparatus for processing liquid metal comprising:

container means associated with said container means;

first electromagnetic inductor means for rotating the liquid metal in said centrifuging means;

wherein said centrifuging means comprises;

an axially symmetric baffle surface having an inner and an outer side, said first inductor means communicating with said outer side;

said container means being connected to said inner side of said baffle surface by an axial connection section; and wherein said baffle surface is arranged coaxially inside a cylindrical impact wall.

34. Device according to claim 33 including:

cooling means for cooling said impact wall.

35. Device according to claim 33 wherein:

said first electromagnetic inductor means is arranged on the outside of said impact wall, said electromagnetic inductor means exerting an inductive rotary field on the metal particles conveyed onto the inside of said impact wall.

36. Device according to claim 33 wherein:

said impact wall is rotatable about its longitudinal axis and about the axis of symmetry of said baffle surface.

37. Device according to claim 33 including:

a hood;

a collecting funnel; and wherein said hood, funnel and impact wall together define a vacuum tight housing about said centrifuging means and said container means.

38. Apparatus for processing liquid metal comprising:

container means for holding liquid metal;

centrifuging means;

wherein said centrifuging means comprises;

an axially symmetric baffle surface having an inner and an outer side, inductor means communicating with said outer side;

said container means being connected to said inner side of said baffle surface by an axial connection section; and compressed gas discharge nozzles directed towards the metal conveyed out of said baffle surface, said nozzles being positioned at the peripheral edge of said baffle surface.

* * * * *